US012648598B2

(12) United States Patent
Swiger et al.

(10) Patent No.: US 12,648,598 B2
(45) Date of Patent: Jun. 9, 2026

(54) ADAPTABLE NURSING GARMENT

(71) Applicants: Mackenzie Lynn Swiger, Holly Springs, NC (US); John Carl Bergstrom, Burlington, CT (US)

(72) Inventors: Mackenzie Lynn Swiger, Holly Springs, NC (US); John Carl Bergstrom, Burlington, CT (US)

( * ) Notice: Subject to any disclaimer, the term of this patent is extended or adjusted under 35 U.S.C. 154(b) by 0 days.

(21) Appl. No.: 18/819,043

(22) Filed: Aug. 29, 2024

(65) Prior Publication Data

US 2025/0072527 A1 Mar. 6, 2025

Related U.S. Application Data

(60) Provisional application No. 63/579,376, filed on Aug. 29, 2023.

(51) Int. Cl.
*A41C 3/04* (2006.01)
*A44B 19/08* (2006.01)

(52) U.S. Cl.
CPC ..... *A41C 3/04* (2013.01); *A44B 19/08* (2013.01)

(58) Field of Classification Search
USPC ..... 450/36
See application file for complete search history.

(56) References Cited

U.S. PATENT DOCUMENTS 3,030,962 A * 4/1962 Garson ..... A41C 3/06 450/41
3,109,431 A * 11/1963 Jefferson ..... A41C 3/0007 450/86
3,203,424 A * 8/1965 Garutso ..... A41C 3/0071 450/36
3,425,420 A * 2/1969 Steinberger ..... A41C 3/0071 450/82
4,222,387 A * 9/1980 Tetu ..... A41C 3/148 450/36
5,938,500 A * 8/1999 Hampton ..... A41C 1/06 450/32
6,319,092 B1 * 11/2001 Leyhe ..... A41C 3/0071 450/36
6,346,027 B1 * 2/2002 Merkovsky ..... A41C 3/04 450/38
6,575,811 B1 * 6/2003 Fildan ..... A41C 3/122 450/41
11,116,259 B1 * 9/2021 Barrett ..... A41C 3/128
(Continued)

FOREIGN PATENT DOCUMENTS

AU 2009201982 A1 12/2009
CN 204048065 U 12/2014

OTHER PUBLICATIONS

ISA/US; International Search Report & Written Opinion for corresponding International Patent Application No. PCT/US24/44339, mailed Jan. 10, 2025, 7 pages.

*Primary Examiner* — Matthew R Marchewka
(74) *Attorney, Agent, or Firm* — NK Patent Law

(57) ABSTRACT

An adaptable nursing garment designed to provide comfort and support during pregnancy and breastfeeding. The adaptable nursing garment is designed for one-handed operation to enable breastfeeding without removal of the strapless nursing garment. The adaptable nursing garment includes a nursing bra including a plurality of supports, a plurality of fasteners, and an elastic component.

2 Claims, 9 Drawing Sheets

(56) References Cited

U.S. PATENT DOCUMENTS

| | | | | |
|---|---|---|---|---|
| 2002/0193048 | A1* | 12/2002 | Kato | A41C 3/128<br>450/1 |
| 2004/0058618 | A1* | 3/2004 | Yang | A41C 3/0071<br>450/38 |
| 2010/0297913 | A1* | 11/2010 | Liegey | A41C 3/0071<br>450/39 |
| 2014/0051331 | A1 | 2/2014 | Handras | |
| 2015/0038051 | A1* | 2/2015 | Fisher | A41C 3/04<br>450/36 |
| 2015/0351464 | A1* | 12/2015 | Getter | A41C 3/04<br>450/36 |
| 2022/0047001 | A1 | 2/2022 | Huyghe | |

* cited by examiner

ADAPTABLE NURSING GARMENT

CROSS-REFERENCE TO RELATED APPLICATIONS

This application claims priority to U.S. Provisional Patent Application No. 63/579,376 entitled "Strapless Nursing Garment" filed on Aug. 29, 2023, the entire contents of which is incorporated by reference herein in its entirety.

BACKGROUND

Maternity and nursing garments are designed to be supportive garments during pregnancy and breastfeeding. One type of nursing garment is a nursing bra. The nursing bra provides additional support to women who are lactating and allows for breastfeeding without removal of the nursing bra. This is typically done with bra cups that are undone with a clasp or hook.

FIELD OF THE INVENTION

The present invention is generally directed to nursing garments, more specifically to adaptable nursing garments.

DESCRIPTION OF RELATED ART

Maternity and nursing garments are designed to support a wearer's breasts as the breasts change in size due to pregnancy and breastfeeding. Current nursing garments have a plurality of problems including (1) visible straps, (2) insufficient support and coverage, (3) breastfeeding difficulties, (4) discomfort, (5) laundering difficulties, and (6) needing two hands for operation and adjustment.

The visible straps of nursing garments are typically positioned around the shoulder and chest area of an individual. As a result, additional clothing that covers the entire shoulder and chest area is worn to hide the straps. Unfortunately, this can result in discomfort and overheating as the additional layer of clothing can increase the temperature experienced by the individual, especially when the external environment has a warm temperature. Additionally, the visible straps are not desired for formal occasions because many dresses and tops do not cover the shoulders and chest area.

Unintended pressure or excess pressure can be a result of a poorly fitted garment and/or an inflexible garment. The excess pressure can cause plugged milk ducts, mastitis, and/or decreased milk supply. Further, many garments do not offer an easy way to allow breastfeeding without requiring the removal of the garment. Some garments may include a hook or clasps to allow for breastfeeding with the removal of the garment. However, individuals with mobility and shoulder issues may have difficulty operating flaps or hooks that are not easily accessible (e.g., positioned on the back of a nursing garment). Additionally, currently nursing garments requires two hands to engage and adjust the flaps and hooks.

Therefore, there is a need for an adaptable nursing garment that improves the comfort of an individual, offers one-handed operation, and facilitates breastfeeding and redressing while an individual is holding a baby in the other arm.

BRIEF SUMMARY

The present invention is generally directed to a nursing garment, more specifically to an adaptable nursing garment.

In some embodiments, the adaptable nursing garment includes a strapless nursing bra. The strapless nursing bra includes at least one cup, a support band, at least one zipper, an underwire, and a clip. In some embodiments, the strapless nursing bra does not include an underwire. Alternatively, or additionally, the strapless nursing bra includes at least one push-up support incorporated into at least one cup.

In one embodiment, the present invention includes an adaptable nursing garment design to facilitate breastfeeding without the removal of the adaptable nursing garment. The adaptable nursing garment includes a plurality of cups, a plurality of zippers, an underwire, an underwire channel, an elastic band, and at least one fastener. The plurality of cups is attached to the elastic band via at least one zipper of the plurality of zippers. Advantageously, each cup of the plurality of cups is movable between an open position and a closed position based on the position of a corresponding zipper. As the corresponding zipper unzips, the cup is operable to move from the closed position to the open position.

In some embodiments, an adaptable nursing garment is disclosed. The adaptable nursing garment includes at least two supports including a first support and a second support. The adaptable nursing garment further includes at least two fasteners including a first zipper and a second zipper. The adaptable nursing garment further includes at least one elastic component. The first zipper includes a first row of zipper teeth and a second row of zipper teeth. The second zipper includes a first row of zipper teeth and a second row of zipper teeth. The first support is attached to the at least one elastic component via the first zipper. The second support is attached to the at least one elastic component via the second zipper. The first support and the second support are operable to move between an open position and a closed position based on a position of the first zipper and a position of the second zipper.

In some embodiments, the first zipper runs along a curvature of the first support and the second zipper runs along a curvature of the second support. In some embodiments, the first zipper is sewn to the first support and the second zipper is sewn to the second support. In some embodiments, the adaptable nursing garment further includes a plurality of notches positioned along a curvature of the first support and a plurality of notches positioned along a curvature of the second support. In some embodiments, when moving from the closed position to the open position, the first support extends away from the elastic component. In some embodiments, the plurality of supports is removably attached to the elastic component. In some embodiments, each support of the plurality of supports includes an interior component including a cushion. In some embodiments, each support of the plurality of supports includes an interior component fastener. The interior component fastener is movable between a locked position and an unlocked position. In the locked position, the interior component is covered.

In some embodiments, the first zipper includes at least one of a double-sided zipper, a centered zipper, an invisible zipper, a lapped zipper, a two-way separating zipper, a separating zipper, or an exposed zipper. In some embodiments, the first row of zipper teeth of the first zipper is positioned on the first support and the second row of zipper teeth of the first zipper is positioned on the elastic component. In some embodiments, the first row of zipper teeth of the second zipper is positioned on the second support and the second row of zipper teeth of the second zipper is positioned on the elastic component. In some embodiments, the first zipper is movable between a locked position and an unlocked position. When in the locked position, the first row of zipper teeth of the first zipper is connected to the second row of zipper teeth of the first zipper. In some embodiments, the adaptable nursing garment further includes underwire. In some embodiments, the first support and the second support are configurated to simultaneously moved from the closed position to the open position.

In some embodiments, an adaptable nursing garment is disclosed. The adaptable nursing garment includes at least two supports including a first support and a second support. The adaptable nursing garment further includes at least two fasteners including a first zipper and a second zipper. The adaptable nursing garment further includes at least one elastic component. The first zipper includes a first row of zipper teeth and a second row of zipper teeth. The second zipper includes a first row of zipper teeth and a second row of zipper teeth. The first support is attached to at least one elastic component via a first zipper that runs along a curvature of the first support. The second support is attached to the at least one elastic component that runs along a curvature of the second support. The first support and the second support are operable to move between an open position and a closed position based on a position of the first zipper and a position of the second zipper.

In some embodiments, the adaptable nursing garment further includes a plurality of notches positioned along the curvature of the first support and the curvature of the second support. In some embodiments, the adaptable nursing garment further includes underwire. The underwire runs underneath each support of the at least two supports. In some embodiments, the first row of zipper teeth of the first zipper is positioned on the first support and the second row of zipper teeth of the first zipper is positioned on the elastic component. The first row of zipper teeth of the second zipper is positioned on the second support and the second row of zipper teeth of the second zipper is positioned on the elastic component.

In some embodiments, the first zipper is movable between a locked position and an unlocked position. In the locked position, the first row of zipper teeth of the first zipper is connected to the second row of zipper teeth of the first zipper. The second zipper is movable between a locked position and an unlocked position. In the locked position, the first row of zipper teeth of the second zipper is connected to the second row of zipper teeth of the second zipper. In the unlocked position, the first row of zipper teeth of the second zipper is disconnected from the second row of zipper teeth of the second zipper.

In some embodiments, when the first zipper moves from the locked position to the unlocked position, the first support is operable to extend away from a wearer. When the second zipper moves from the locked position to the unlocked position, the second support is operable to extend away from the wearer.

BRIEF DESCRIPTION OF THE SEVERAL VIEWS OF THE DRAWINGS

The embodiments illustrated, described, and discussed herein are illustrative of the present invention. As these embodiments of the present invention are described with reference to illustrations, various modifications, or adaptations of the methods and or specific structures described may become apparent to those skilled in the art. It will be appreciated that modifications and variations are covered by the above teachings and within the scope of the appended claims without departing from the spirit and intended scope thereof. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

DETAILED DESCRIPTION

Figure 1:
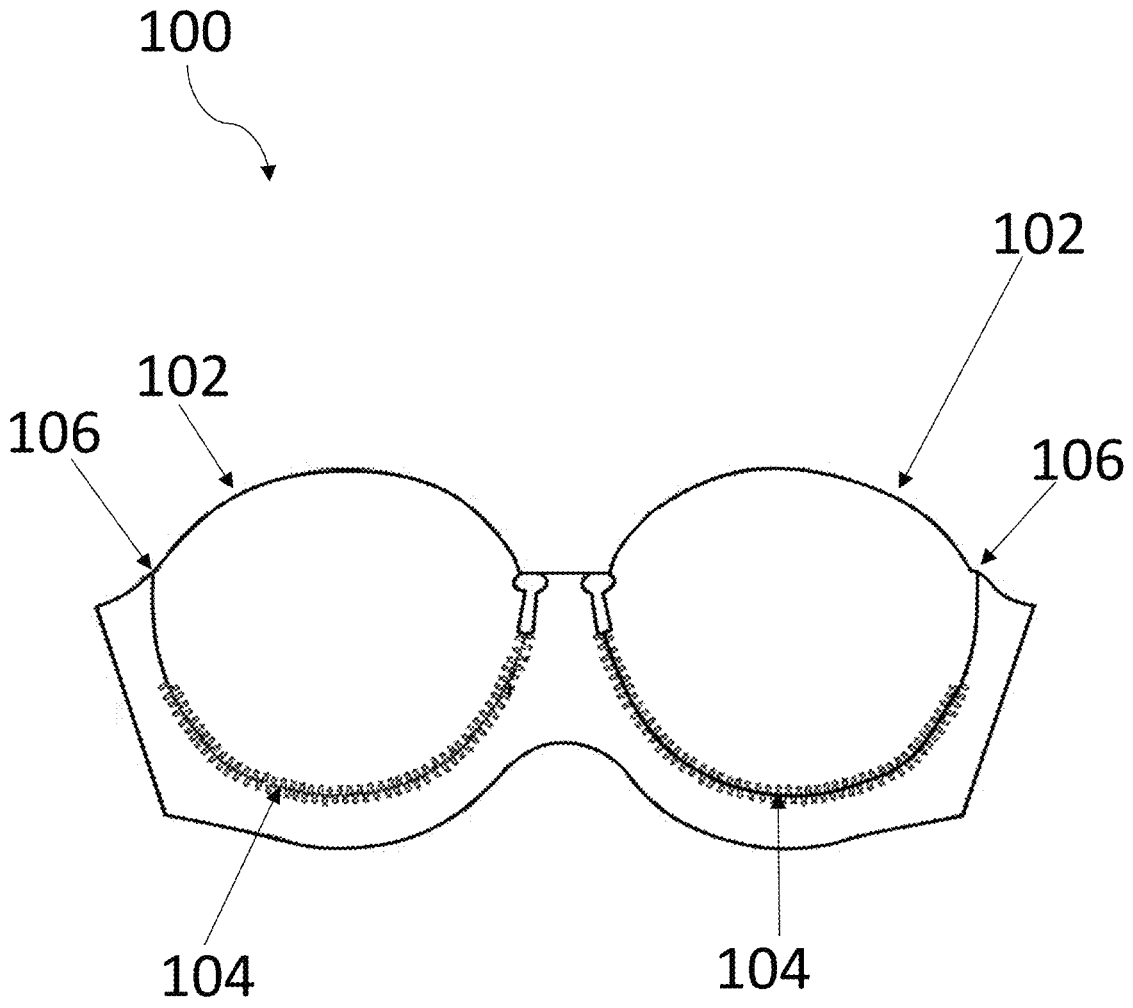
FIG. 1 illustrates a front perspective view of an adaptable nursing garment according to one embodiment of the present invention.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the presently disclosed subject matter.

The present invention is generally directed to a nursing garment, more specifically to an adaptable nursing garment. In some embodiments, the adaptable nursing garment includes an adaptable nursing bra. The adaptable nursing bra includes at least one cup, a support band, at least one zipper, an underwire, and a clip. In some embodiments, the adaptable nursing bra does not include an underwire. The adaptable nursing bra can include at least one push-up support incorporated into at least one cup.

In one embodiment, the present invention includes an adaptable nursing garment design to facilitate breastfeeding without the removal of the adaptable nursing garment. The adaptable nursing garment includes a plurality of cups, a plurality of zippers, an underwire, an underwire channel, an elastic band, and at least one fastener. The plurality of cups is attached to the elastic band via at least one zipper of the plurality of zippers. Advantageously, each cup of the plurality of cups is movable between an open position and a closed position based on the position of a corresponding zipper. As the corresponding zipper unzips, the cup is operable to move from the closed position to the open position.

In some embodiments, an adaptable nursing garment is disclosed. The adaptable nursing garment includes at least two supports including a first support and a second support. The adaptable nursing garment further includes at least two fasteners including a first zipper and a second zipper. The adaptable nursing garment further includes at least one elastic component. The first zipper includes a first row of zipper teeth and a second row of zipper teeth. The second zipper includes a first row of zipper teeth and a second row of zipper teeth. The first support is attached to the at least one elastic component via the first zipper. The second support is attached to the at least one elastic component via the second zipper. The first support and the second support are operable to move between an open position and a closed position based on a position of the first zipper and a position of the second zipper.

In some embodiments, the first zipper runs along a curvature of the first support and the second zipper runs along a curvature of the second support. In some embodiments, the first zipper is sewn to the first support and the second zipper is sewn to the second support. In some embodiments, the adaptable nursing garment further includes a plurality of notches positioned along a curvature of the first support and a plurality of notches positioned along a curvature of the second support. In some embodiments, when moving from the closed position to the open position, the first support extends away from the elastic component. In some embodiments, the plurality of supports is removably attached to the elastic component. In some embodiments, each support of the plurality of supports includes an interior component including a cushion. In some embodiments, each support of the plurality of supports includes an interior component fastener. The interior component fastener is movable between a locked position and an unlocked position. In the locked position, the interior component is covered.

In some embodiments, the first zipper includes at least one of a double-sided zipper, a centered zipper, an invisible zipper, a lapped zipper, a two-way separating zipper, a separating zipper, or an exposed zipper. In some embodiments, the first row of zipper teeth of the first zipper is positioned on the first support and the second row of zipper teeth of the first zipper is positioned on the elastic component. In some embodiments, the first row of zipper teeth of the second zipper is positioned on the second support and the second row of zipper teeth of the second zipper is positioned on the elastic component. In some embodiments, the first zipper is movable between a locked position and an unlocked position. When in the locked position, the first row of zipper teeth of the first zipper is connected to the second row of zipper teeth of the first zipper. In some embodiments, the adaptable nursing garment further includes underwire. In some embodiments, the first support and the second support are configurated to simultaneously moved from the closed position to the open position.

In some embodiments, an adaptable nursing garment is disclosed. The adaptable nursing garment includes at least two supports including a first support and a second support. The adaptable nursing garment further includes at least two fasteners including a first zipper and a second zipper. The adaptable nursing garment further includes at least one elastic component. The first zipper includes a first row of zipper teeth and a second row of zipper teeth. The second zipper includes a first row of zipper teeth and a second row of zipper teeth. The first support is attached to at least one elastic component via a first zipper that runs along a curvature of the first support. The second support is attached to the at least one elastic component that runs along a curvature of the second support. The first support and the second support are operable to move between an open position and a closed position based on a position of the first zipper and a position of the second zipper.

In some embodiments, the adaptable nursing garment further includes a plurality of notches positioned along the curvature of the first support and the curvature of the second support. In some embodiments, the adaptable nursing garment further includes underwire. The underwire runs underneath each support of the at least two supports. In some embodiments, the first row of zipper teeth of the first zipper is positioned on the first support and the second row of zipper teeth of the first zipper is positioned on the elastic component. The first row of zipper teeth of the second zipper is positioned on the second support and the second row of zipper teeth of the second zipper is positioned on the elastic component.

In some embodiments, the first zipper is movable between a locked position and an unlocked position. In the locked position, the first row of zipper teeth of the first zipper is connected to the second row of zipper teeth of the first zipper. The second zipper is movable between a locked position and an unlocked position. In the locked position, the first row of zipper teeth of the second zipper is connected to the second row of zipper teeth of the second zipper. In the unlocked position, the first row of zipper teeth of the second zipper is disconnected from the second row of zipper teeth of the second zipper.

In some embodiments, when the first zipper moves from the locked position to the unlocked position, the first support is operable to extend away from a wearer. When the second zipper moves from the locked position to the unlocked position, the second support is operable to extend away from the wearer.

In some embodiments, as shown in FIG. 1, the present invention includes an adaptable nursing garment 100 comprising a plurality of supports 102, a plurality of fasteners 104, a plurality of seams 106, and an elastic component (not shown). In one embodiment, the plurality of supports 102 includes at least one cup designed to support and receive a breast of an individual.

In some embodiments, the plurality of fasteners is stitched to the nursing garment. Alternatively, or additionally, the plurality of fasteners is sewn to the nursing garment. In some embodiments, the plurality of fasteners 104 includes at least one zipper. The zipper includes a plurality of zipper teeth attached (e.g., sewn) to a corresponding support. Advantageously, the plurality of zipper teeth is aligned with the shape and curvature of the corresponding support.

In some embodiments, the adaptable nursing garment includes a plurality of notches positioned around the curve of the cup that enables the zipper to track along the curve of the cup. Each support of the plurality of supports is designed to move between an open and a closed position. When the zipper is in a locked position, the support is in a closed position and covers the breast of an individual. When the zipper moves to an unlocked position, the plurality of zipper teeth is no longer connected, and the support is operable to extend away from an individual. For example, and not limitation, the support flips open. Advantageously, this enables an individual to breastfeed without taking off the nursing garment.

In some embodiments, the plurality of supports is entirely detachable from the nursing garment. In other embodiments, the plurality of supports is permanently attached to the adaptable nursing garment. In some embodiments, each support of the plurality of supports includes at least one additional fastener (e.g., zipper) that provides access to the interior portion of the support. For example, and not limitation, each support includes an interior compartment with a cushion or similar support material. The additional zipper provides interior access to each support, thereby allowing the interior cushion to be removed and swapped. Advantageously, this enables individuals to adjust the garment to a desired comfort and size.

In some embodiments, the adaptable nursing garment includes a plurality of zippers. For example, and not limitation, the plurality of zippers includes a first zipper positioned on a first cup and a second zipper on a second cup. Advantageously, each zipper is designed for one-handed functionality. For further example and not limitation, at least one zipper runs from about the sternum of an individual to about the armpit of an individual and is designed to form the shape of a cup.

For further example, in some embodiments, at least one zipper includes a double-sided zipper, a centered zipper, an invisible zipper (e.g., not visible from at least one side), a lapped zipper, a two-way separating zipper, a separating zipper, and/or an exposed zipper. In some embodiments, the zipper includes a plastic and/or metal material. For example, and not limitation, in one embodiment, the zipper does not include nylon. Notably, during the development of the adaptable nursing garment, nylon zippers were generally found to not allow one-handed functionality.

In some embodiments, the adaptable nursing garment includes an adaptable nursing bra. The adaptable nursing bra includes at least one cup, an elastic band, at least one zipper, an underwire, an underwire channel, and at least one clip or similar fastener. The underwire is positioned within the fabric of the nursing garment and runs under each support of the plurality of supports. For example, and not limitation, the underwire runs from about the sternum of an individual to about the armpit of the sternum. For further example, in some embodiments, the underwire is positioned underneath the plurality of fasteners. The elastic band is attached to the side of the plurality of supports and is designed to wrap around an individual. In some embodiments, the underwire follows the border of the full circumference of the cup. The underwire channel is designed to run along the entire length of the cup. In some embodiments, the underwire channel is removably attached to the adaptable nursing garment. In some embodiments, the underwire channel is sewn on the adaptable nursing garment. Alternatively, or additionally, in some embodiments, the adaptable nursing bra includes at least one push-up support. For example, and without limitation, the at least one push-up support is incorporated into each support of the plurality of support to provide additional cushion.

In some embodiments, the adaptable nursing garment is operable to receive a strap. For example and not limitation, in some embodiments, the nursing garment includes a hook, a clip, or a similar fastener to attach to a strap. In some embodiments, the adaptable nursing garment further includes a breast pad designed to help with milk leakage. In some embodiments, the breast pad attaches to an interior surface of the plurality of supports. Advantageously, the removable breast pad enables an individual to place one or both supports as needed (e.g., wet from lactation). Yet another advantage, the removable breast pad enables an individual to use breast pads of various sizes to better address body changes throughout pregnancy without needing a separate nursing garment. Alternatively, in at least one embodiment, the breast pad is permanently attached to the interior of a cup.

Figure 2:
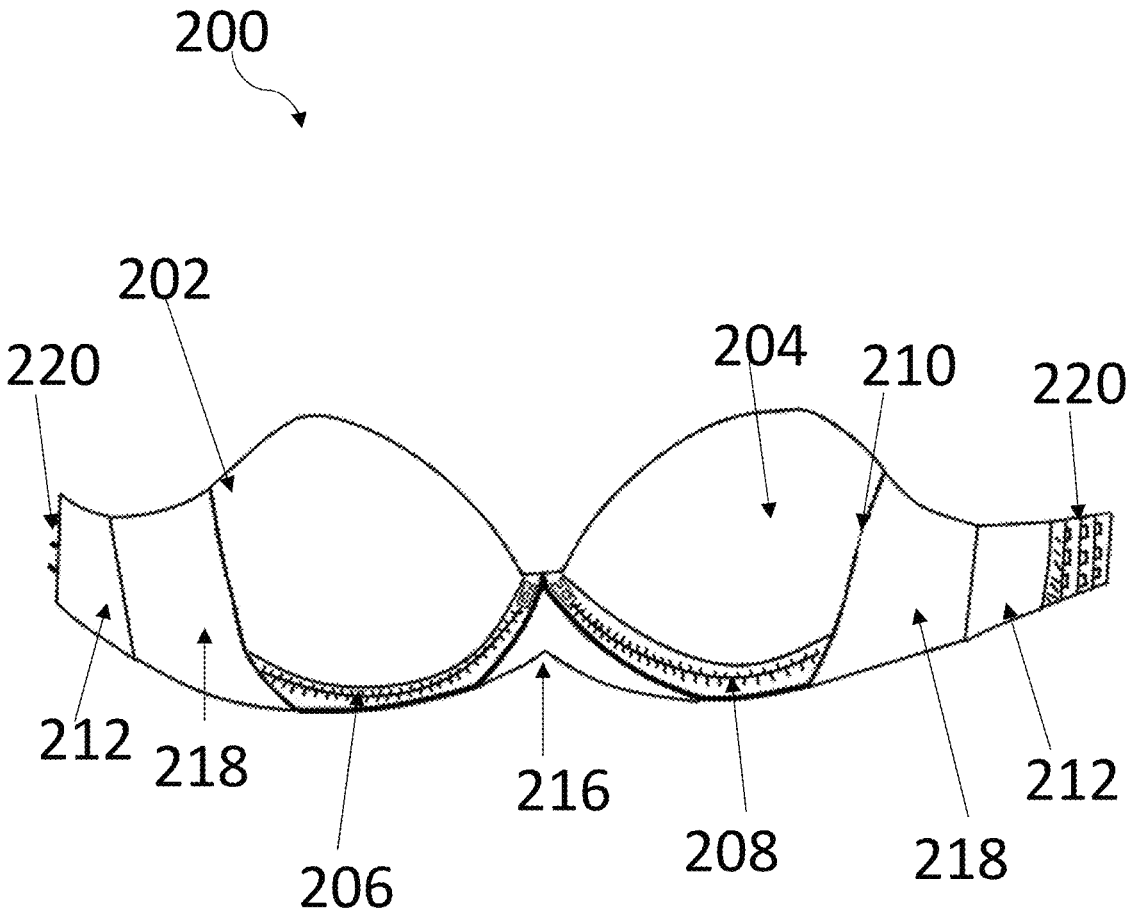
FIG. 2 illustrates a front perspective view of an adaptable nursing garment according to one embodiment of the present invention.

In some embodiments, as shown in FIG. 2, the adaptable nursing garment 200 includes a first cup 202, a second cup 204, a first zipper 206, a second zipper 208, an underwire 210, a band 212, and a protective zipper component (not shown). The band 212 includes a central panel 216, wings 218, and back hooks 220. The protective zipper component provides a barrier between each zipper and the skin of a wearer. Advantageously, this prevents the skin of the wearer from being pinched and/or coming into contact with the zipper. Each zipper is attached (e.g., sewn) to the protective zipper component, and the protective zipper component is attached (e.g., sewn) to the garment.

Figure 3:
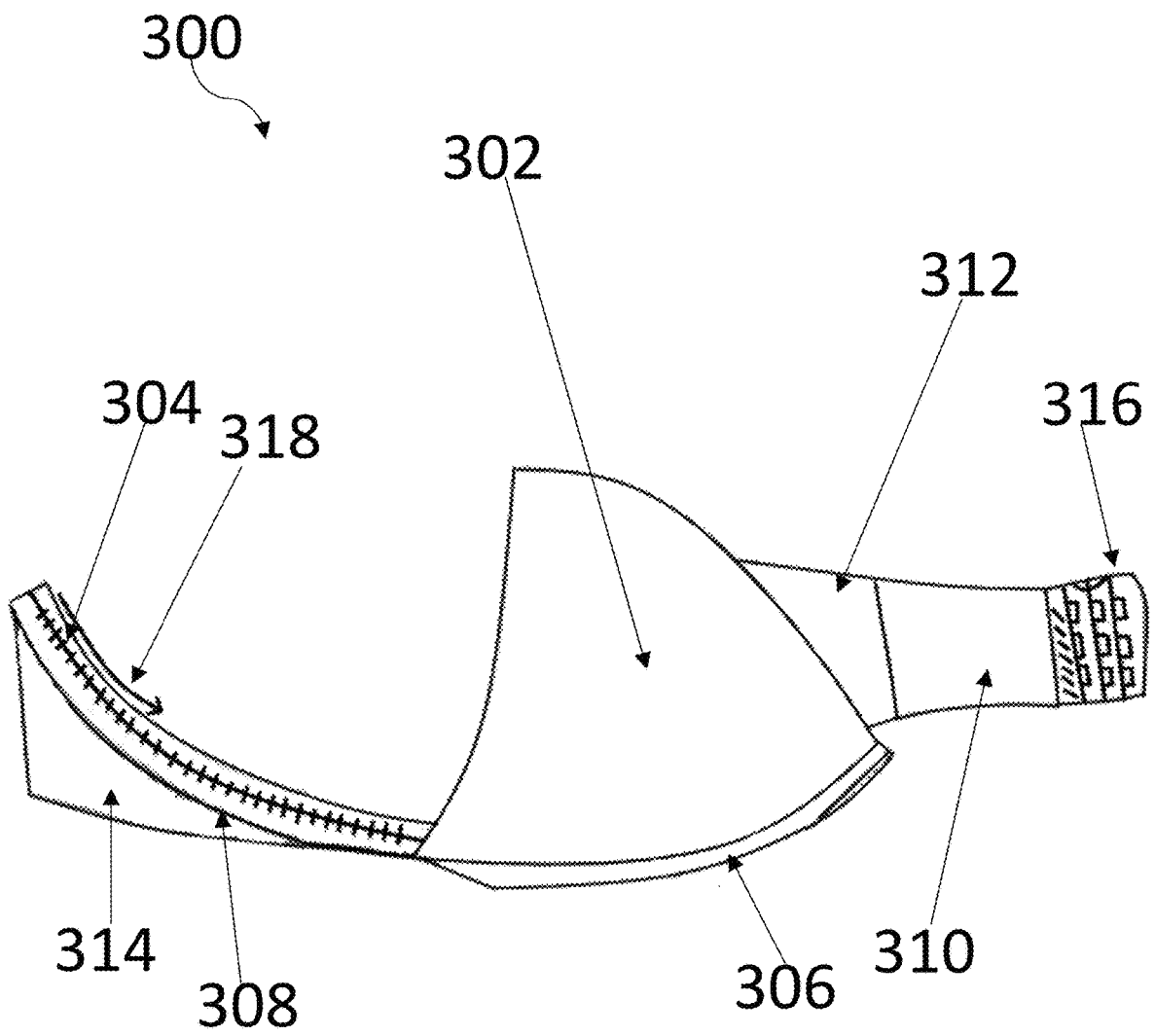
FIG. 3 illustrates a side perspective view of an adaptable nursing garment according to one embodiment of the present invention.

FIG. 3 illustrates a side view of an adaptable nursing garment according to one embodiment of the present invention. The adaptable nursing garment 300 includes a cup 302, a zipper 304, a zipper cover 306, an underwire 308, a band 310, a band wing 312, a band center panel 314, and a plurality of back hooks 316. The zipper 304 moves from the armpit to the sternum of the wearer as indicated by the arrow 318. The zipper cover 306 protects the zipper from external elements.

In some embodiments, the adaptable nursing garment includes a plurality of zippers. In some embodiments, the plurality of zippers is stitched to the adaptable nursing garment. Alternatively, or additionally, the plurality of fasteners is sewn to the adaptable nursing garment.

For example, and not limitation, the plurality of zippers includes a first zipper positioned on a first cup and a second zipper on a second cup. Advantageously, each zipper is designed for one-handed functionality. For further example and not limitation, at least one zipper runs from about the sternum of an individual to about the armpit of an individual and is designed to form the shape of a cup.

For further example, in some embodiments, at least one zipper includes a double-sided zipper, a centered zipper, an invisible zipper (e.g., not visible from at least one side), a lapped zipper, a two-way separating zipper, a separating zipper, and/or an exposed zipper. In some embodiments, the zipper includes a plastic and/or metal material. For example, and not limitation, in one embodiment, the zipper does not include nylon. Notably, during the development of the adaptable nursing garment, nylon zippers were generally found to not allow one-handed functionality.

In some embodiments, the adaptable nursing garment includes an underwire and elastic band. The underwire is positioned within the fabric of the nursing garment and runs under each support of the plurality of supports. The elastic band is attached to a side of each support of the plurality of supports and is designed to wrap around an individual. For example, and not limitation, the underwire runs from about the sternum of an individual to about the armpit of the sternum. For further example, in some embodiments, the underwire is positioned underneath the plurality of fasteners. In some embodiments, the underwire follows the border of the full circumference of the cup. Alternatively, or additionally, in some embodiments, the adaptable nursing bra includes at least one push-up support. The at least one push-up support is incorporated into each support of the plurality of supports to provide additional cushion. In some embodiments, the adaptable nursing garment is operable to receive a strap. For example and not limitation, in some embodiments, the nursing garment includes a hook, a clip, or a similar fastener to attach to a strap.

In some embodiments, the adaptable nursing garment further includes a breast pad designed to help with milk leakage. For example, and not limitation, in one embodiment, the breast pad attaches to an interior surface of the plurality of supports. In another embodiment, the breast pad is permanently attached to the interior of a support (e.g., a cup).

Figure 4:
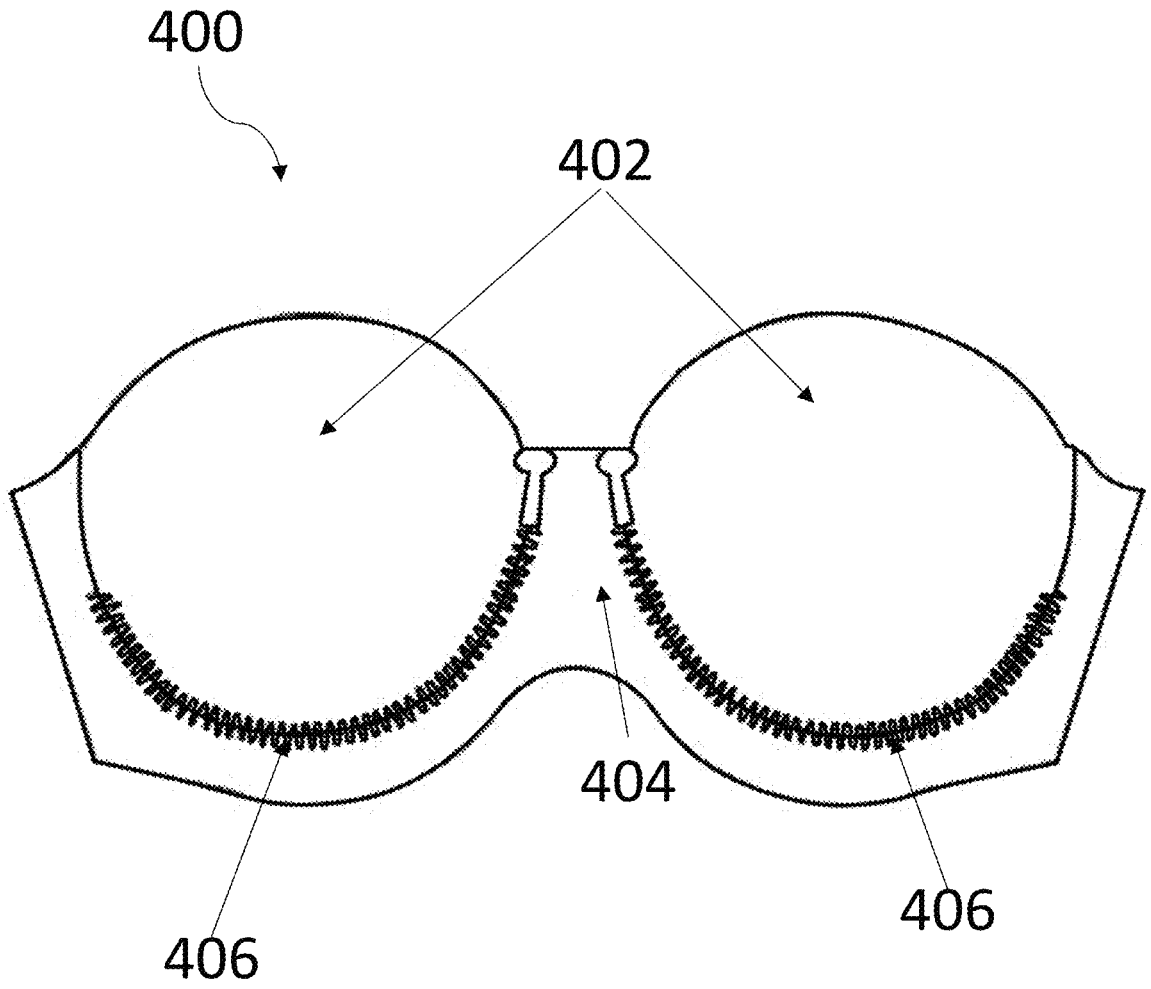
FIG. 4 illustrates a front perspective view of an adaptable nursing garment according to one embodiment of the present invention.
Figure 5:
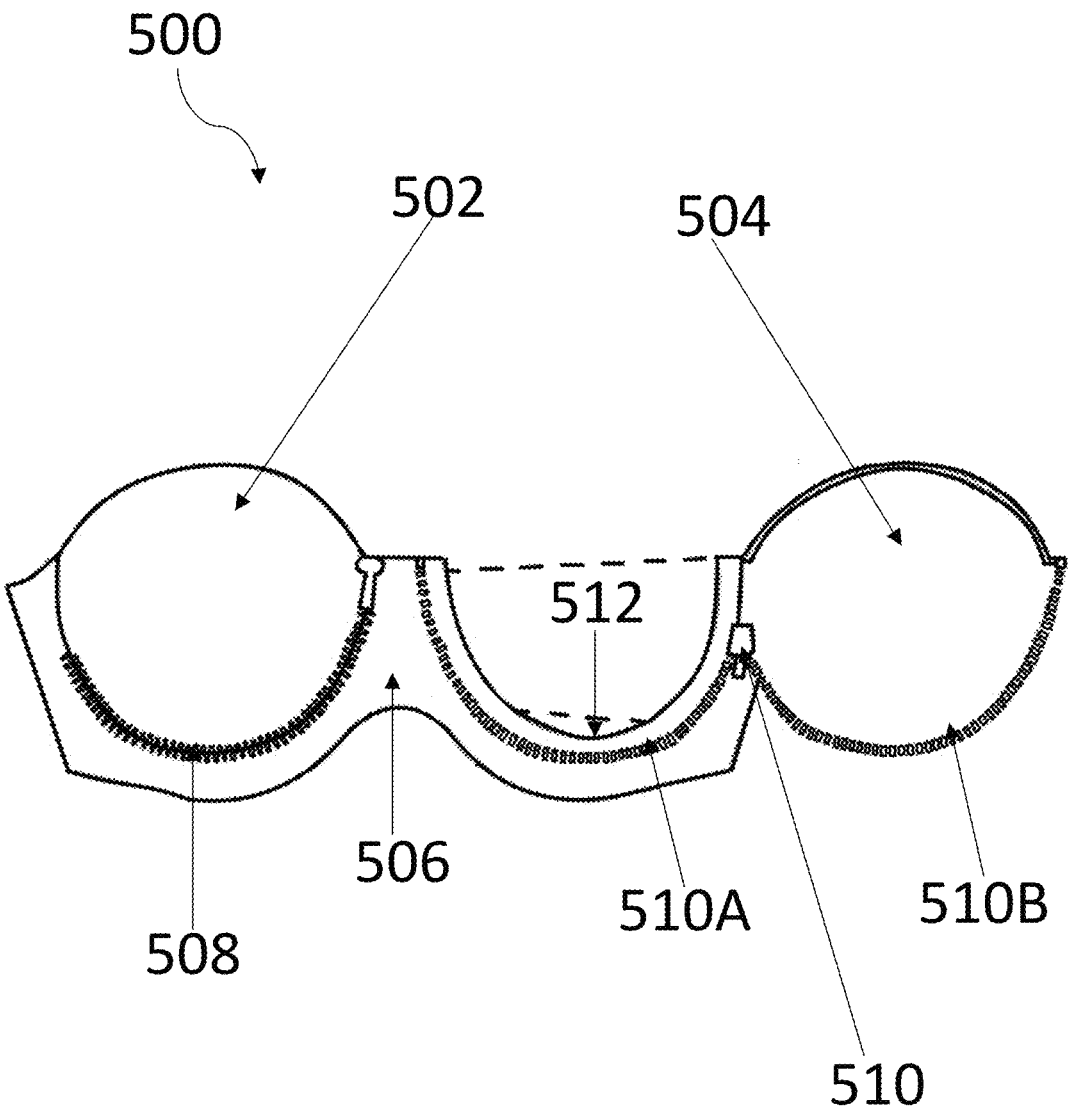
FIG. 5 illustrates a front perspective view of an adaptable nursing garment with a cup in an open position according to one embodiment of the present invention.
Figure 6:
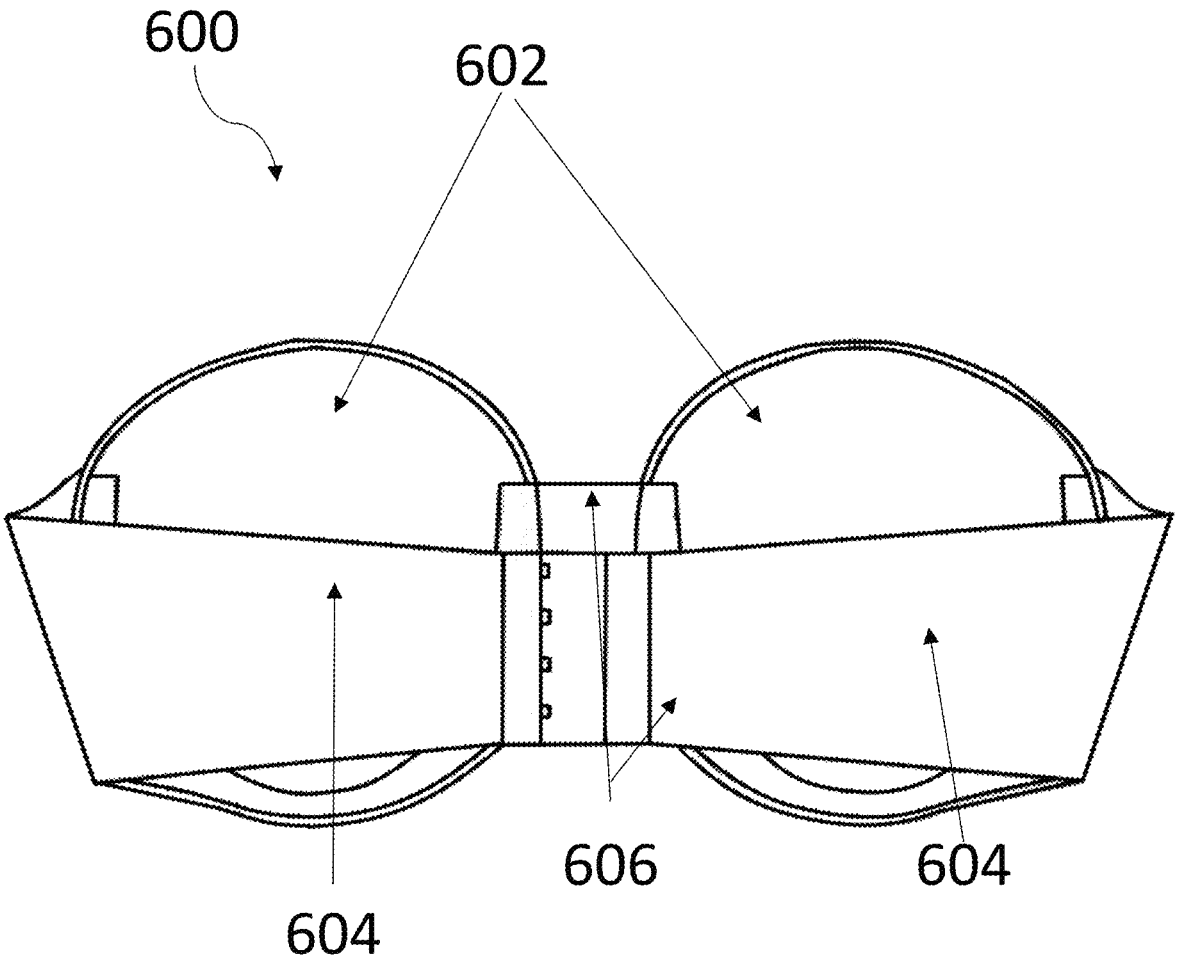
FIG. 6 illustrates a rear perspective view of an adaptable nursing garment according to one embodiment of the present invention.

FIG. 4 illustrates a front perspective view of an adaptable nursing garment according to one embodiment of the present invention. The adaptable nursing garment includes a plurality of cups 402, an elastic band 404, and a plurality of zippers 406. FIG. 5 illustrates a front perspective view of an adaptable nursing garment in an open position according to one embodiment. The adaptable nursing garment 500 includes a first cup 502, a second cup 504, an elastic band 506, a first zipper 508, a second zipper 510, and a zipper shroud 512. The first cup 502 and/or the second cup 504 are designed to move between an open and a closed position. When the zipper is in a locked position, the cup is in a closed position and covers the breast of an individual. When the zipper moves to an unlocked position, the plurality of zipper teeth is no longer connected, and the cup is operable to extend away from an individual. For example, and not limitation, as shown in FIG. 5, the second cup 504 flips in an outward direction with a plurality of zipper teeth remaining attached to the garment 510A and a plurality of zipper teeth 510B remaining attached to the cup 504. Advantageously, this enables an individual to breastfeed without taking off the nursing garment. FIG. 6 illustrates a rear perspective view of an adaptable nursing garment according to one embodiment of the present invention. The adaptable nursing garment includes a plurality of cups 602, an elastic band 604, and a zipper shroud 606. Advantageously, the zipper shroud covers at least one zipper and prevents the at least one zipper from coming into contact with a wearer.

In some embodiments, the adaptable nursing garment includes a plurality of zippers. For example, and not limitation, the plurality of zippers includes a first zipper positioned on a first cup and a second zipper on a second cup. Advantageously, each zipper is designed for one-handed functionality. For further example and not limitation, at least one zipper runs from about the sternum of an individual to about the armpit of an individual and is designed to form the shape of a cup.

For further example, in some embodiments, at least one zipper includes a double-sided zipper, a centered zipper, an invisible zipper (e.g., not visible from at least one side), a lapped zipper, a two-way separating zipper, a separating zipper, and/or an exposed zipper. In some embodiments, the zipper includes a plastic and/or metal material. For example, and not limitation, in one embodiment, the zipper does not include nylon. Notably, during the development of the adaptable nursing garment, nylon zippers were generally found to not allow one-handed functionality.

In some embodiments, the adaptable nursing garment includes an underwire and elastic band. The underwire is positioned within the fabric of the nursing garment and runs under each support of the plurality of supports. For example, and not limitation, the underwire runs from about the sternum of an individual to about the armpit of the sternum. For further example, in some embodiments, the underwire is positioned underneath the plurality of fasteners. The elastic band is attached to the side of the plurality of supports and is designed to wrap around an individual. In some embodiments, the underwire follows the border of the full circumference of the cup. Alternatively, or additionally, in some embodiments, the adaptable nursing bra includes at least one push-up support. The at least one push-up support is incorporated into each support of the plurality of supports to provide additional cushion.

In some embodiments, the adaptable nursing garment is operable to receive a strap. For example and not limitation, in some embodiments, the nursing garment includes a hook, a clip, or a similar fastener to attach to a strap. In some embodiments, the adaptable nursing garment further includes a breast pad designed to help with milk leakage. For example, and not limitation, in one embodiment the breast pad attaches to an interior surface of the plurality of supports. In another embodiment, the breast pad is permanently attached to the interior of a support (e.g., a cup).

Figure 7:
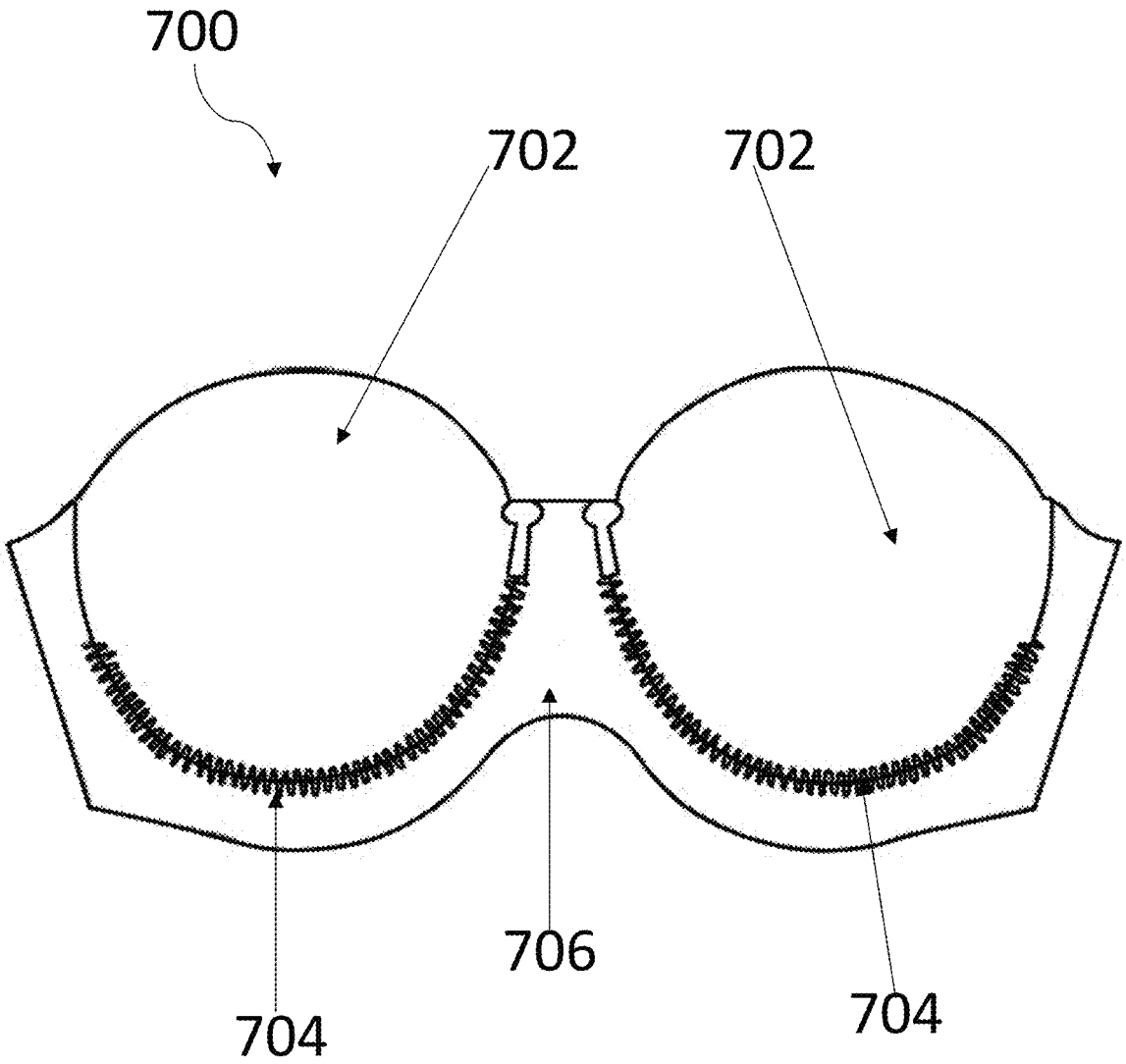
FIG. 7 illustrates a front perspective view of an adaptable nursing garment according to one embodiment of the present invention.
Figure 8:
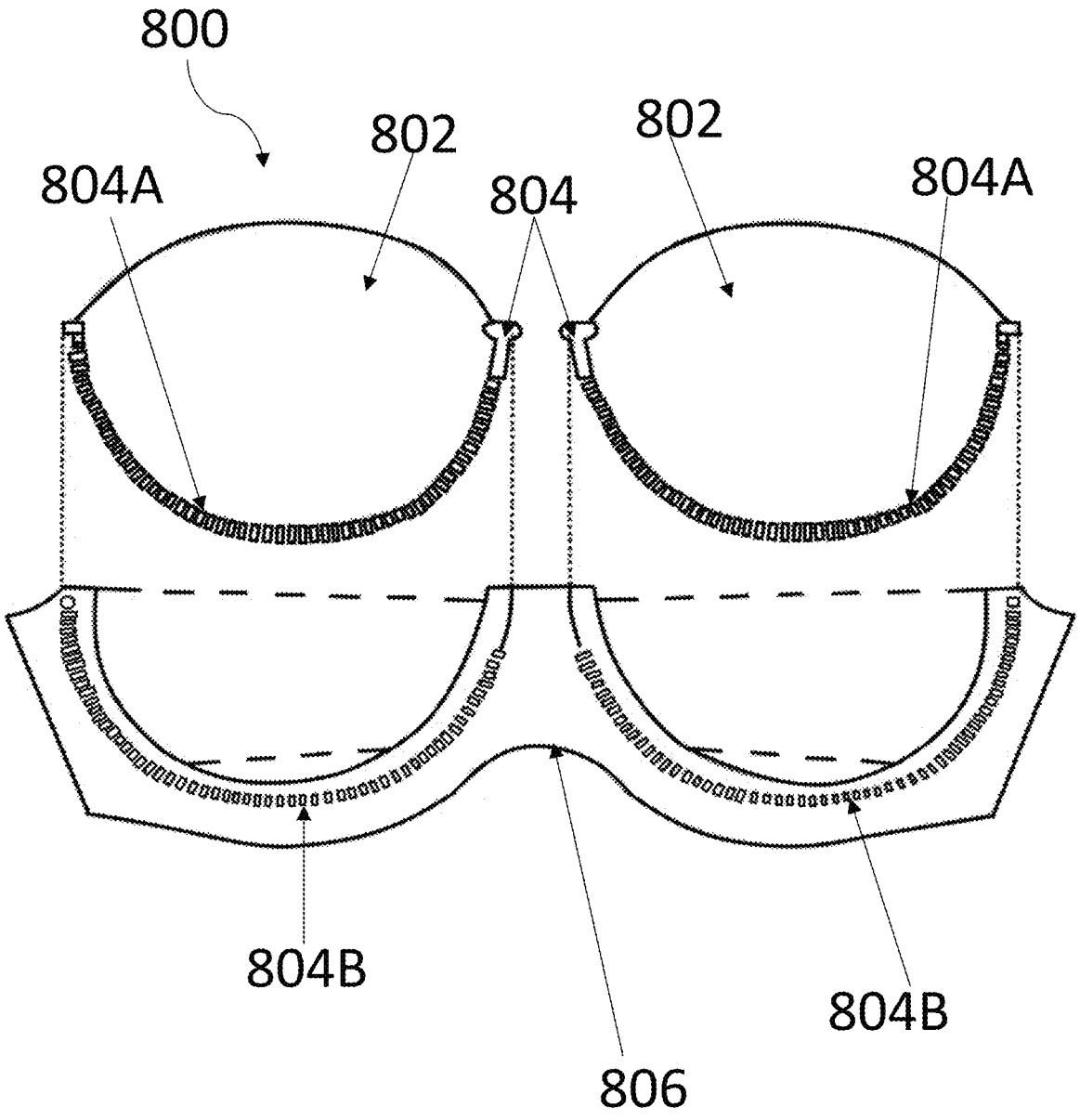
FIG. 8 illustrates a front perspective view of an adaptable nursing garment with removable cups according to one embodiment of the present invention.

FIG. 7 illustrates a front perspective view of an adaptable nursing garment according to one embodiment of the present invention. The adaptable nursing garment 700 includes a plurality of cups 702, a plurality of zippers 704, and an elastic band 706. According to one embodiment, as shown in FIG. 8, the adaptable nursing garment includes but is not limited to, a plurality of removable cups 802, a plurality of zippers 804, and an elastic band 806. The plurality of removable cups 802 is removably attached to the adaptable nursing garment 800 via the plurality of zippers 804. In some embodiments, the adaptable nursing garment includes a plurality of notches positioned around the curve of the cup that enables the zipper to track along the curve of the cup. For further example, in some embodiments, the zipper is designed to run around the entirety of the cup and the cup is designed to completely detach from the adaptable nursing garment. Each zipper of the plurality of zippers 804 includes a first set of zipper teeth 804A and a second zipper of zipper teeth 804A. When the first set of zipper teeth 804A and the second set of zipper teeth 804B are connected, the removable cup is attached to the adaptable nursing garment. When the first set of zipper teeth 804A and the second set of zipper teeth 804B are not connected, the entire removable cup is removable from the adaptable nursing garment. Advantageously, this enables a wearer to breastfeed without removing the entire adaptable nursing garment.

Figure 9:
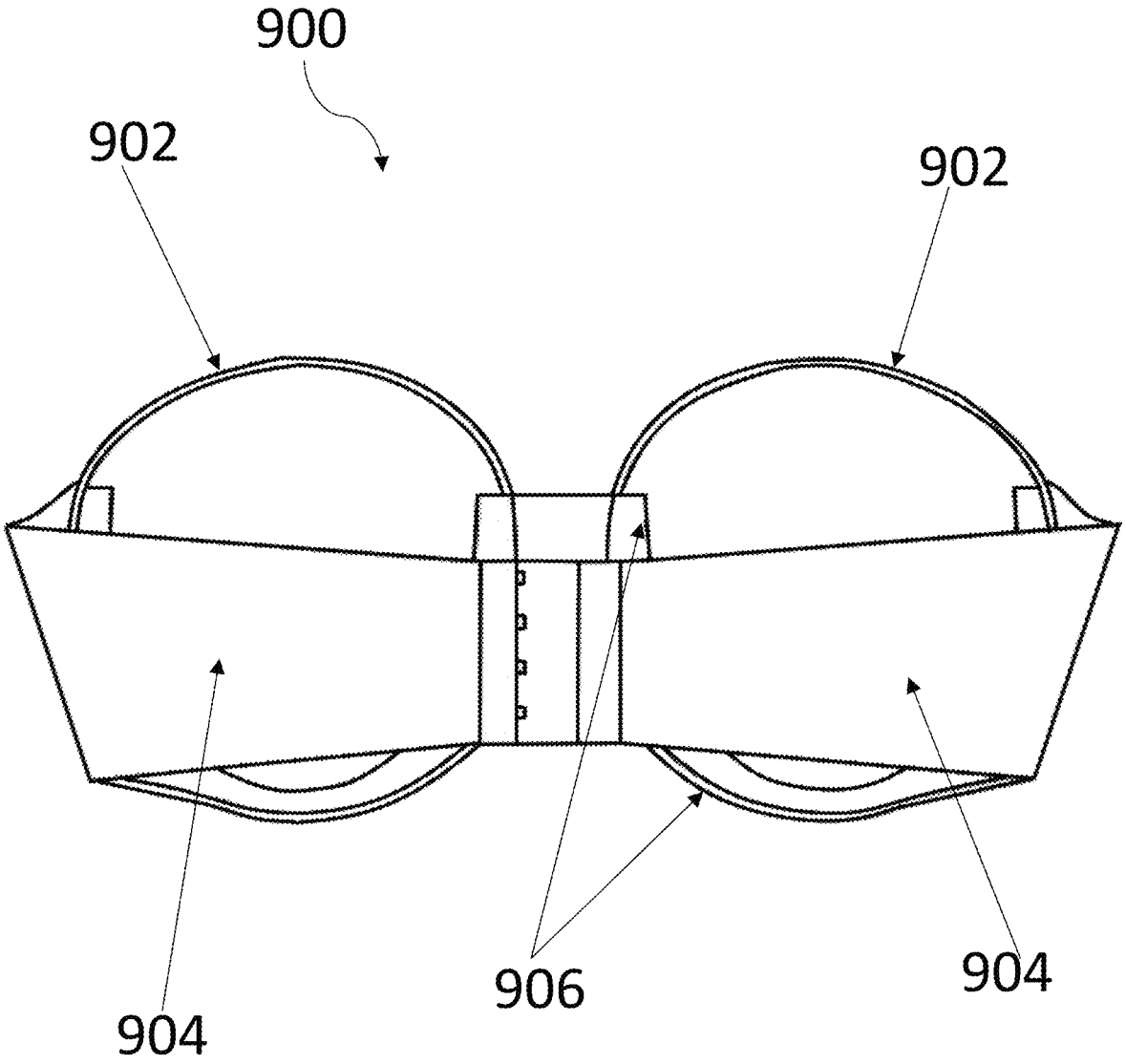
FIG. 9 illustrates a rear perspective view of an adaptable nursing garment with removable cups according to one embodiment of the present invention.

FIG. 9 illustrates a rear perspective view of an adaptable nursing garment according to one embodiment of the present invention. The adaptable nursing garment 900 includes a plurality of cups 902, an elastic band 904, and a zipper shroud 906. The plurality of cups 902 is connected via the elastic band 904. For example, and not limitation, the elastic band is sewn or similarly fastened to each cup of the plurality of cups 902. Alternatively, the elastic band 904 is removably attached to at least one cup or the plurality of cups. In one embodiment, the elastic band includes two separate components. Each elastic band component is connected to a separate cup. Further, each separate elastic band component is removably connected to the other elastic band component via a fastener (e.g., hook, latch, clip). Alternatively, the elastic band is a unitary piece.

In some embodiments, the adaptable nursing garment includes a plurality of zippers. For example, and not limitation, the plurality of zippers includes a first zipper positioned on a first cup and a second zipper on a second cup. Advantageously, each zipper is designed for one-handed functionality. For further example and not limitation, at least one zipper runs from about the sternum of an individual to about the armpit of an individual and is designed to form the shape of a cup.

For further example, in some embodiments, at least one zipper includes a double-sided zipper, a centered zipper, an invisible zipper (e.g., not visible from at least one side), a lapped zipper, a two-way separating zipper, a separating zipper, and/or an exposed zipper. In some embodiments, the zipper includes a plastic and/or metal material. For example, and not limitation, in one embodiment, the zipper does not include nylon. Notably, during the development of the adaptable nursing garment, nylon zippers were generally found to not allow one-handed functionality.

In some embodiments, the adaptable nursing garment includes an underwire and elastic band. The underwire is positioned within the fabric of the nursing garment and runs under each support of the plurality of supports. For example, and not limitation, the underwire runs from about the sternum of an individual to about the armpit of the sternum. For further example, in some embodiments, the underwire is positioned underneath the plurality of fasteners. In some embodiments, the underwire follows the entire circumference of the cup. The elastic band is attached to a side of each support of the plurality of supports and is designed to wrap around an individual. Alternatively, or additionally, in some embodiments, the adaptable nursing bra includes at least one push-up support. The at least one push-up support is incorporated into each support of the plurality of supports to provide additional cushion.

In some embodiments, the adaptable nursing garment is operable to receive a strap. For example and not limitation, in some embodiments, the nursing garment includes a hook, a clip, or a similar fastener to attach to a strap. In some embodiments, the adaptable nursing garment further includes a breast pad designed to help with milk leakage. For example, and not limitation, in one embodiment, the breast pad attaches to an interior surface of the plurality of supports. In another embodiment, the breast pad is permanently attached to the interior surface of a support (e.g., a cup).

Particular embodiments and features have been described with reference to the drawings. It is to be understood that these descriptions are not limited to any single embodiment or any particular set of features, and that similar embodiments and features may arise, or modifications and additions may be made without departing from the scope of these descriptions and the spirit of the appended claims.

These and other changes can be made to the disclosure in light of the above Detailed Description. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

What is claimed is:

1. A strapless adaptable nursing garment consisting of:

two removable supports including a first removable support and a second removable support;

two fasteners including a first zipper and a second zipper; and an elastic component;

wherein the first zipper is sewn to the first removable support, wherein the second zipper is sewn to the second removable support, wherein the first zipper is sewn to fit a curvature of the first removable support, wherein the second zipper is sewn to fit a curvature of the second removable support, wherein the first zipper runs from a first side of the first removable support toward a second side of the first removable support, wherein the first side of the first removable support is positioned adjacent a central region of elastic component, wherein the second side of the first removable support is located proximate to a first outer region of the elastic component, wherein the central region of the elastic component is positioned between the first removable support and the second removable support, wherein the second zipper runs from a first side of the second removable support toward a second side of the second removable support, wherein the first side of the second removable support is positioned adjacent the central region of the elastic component, wherein the second side of the second removable support is located proximate to a second outer region of the elastic component;

wherein two removable supports are removably attached to the elastic component, wherein each support of the two removable supports is entirely removable from the elastic component;

wherein the first zipper includes a first row of zipper teeth and a second row of zipper teeth;

wherein the second zipper includes a first row of zipper teeth and a second row of zipper teeth;

wherein the first removable support is removably attached to the elastic component via the first zipper;

wherein the second removable support is removably attached to the elastic component via the second zipper;

wherein the first removable support is movable between an open position and a closed position based on a position of the first zipper;

wherein the second removable support is movable between an open position and a closed position based on a position of the second zipper, wherein as the first removable support moves from the closed position to the open position, the first removable support extends away from the central region of the elastic component; and wherein as the second removable support moves from the closed position to the open position, the second removable support extends away from the central region of the elastic component.

2. The strapless adaptable nursing garment of claim 1, wherein the first zipper is movable between a locked position and an unlocked position, when in the locked position, the first row of zipper teeth of the first zipper is connected to the second row of zipper teeth of the first zipper, wherein the second zipper is movable between a locked position and an unlocked position, wherein, in the locked position, the first row of zipper teeth of the second zipper is connected to the second row of zipper teeth of the second zipper, wherein, in the unlocked position, the first row of zipper teeth of the second zipper is completely disconnected from the second row of zipper teeth of the second zipper.

* * * * *